US009328680B2

(12) United States Patent
Hashemi et al.

(10) Patent No.: US 9,328,680 B2
(45) **Date of Patent: *May 3, 2016**

(54) METHOD AND SYSTEM FOR ENGINE SPEED CONTROL

(71) Applicant: Ford Global Technologies, LLC, Dearborn, MI (US)

(72) Inventors: Sam Hashemi, Farmington Hills, MI (US); Payam Naghshtabrizi, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 266 days.

This patent is subject to a terminal disclaimer.

(21) Appl. No.: 14/081,513

(22) Filed: Nov. 15, 2013

(65) Prior Publication Data

US 2014/0074376 A1 Mar. 13, 2014

Related U.S. Application Data

(63) Continuation of application No. 13/098,683, filed on May 2, 2011, now Pat. No. 8,600,648.

(51) Int. Cl.

| | |
|---|---|
| ***F02D 41/26*** | (2006.01) |
| ***F02D 41/00*** | (2006.01) |
| ***F02D 41/06*** | (2006.01) |
| ***F02D 41/24*** | (2006.01) |
| *F02N 11/08* | (2006.01) |

(52) U.S. Cl.

CPC ..... *F02D 41/008* (2013.01); *F02D 41/065* (2013.01); *F02D 41/2454* (2013.01); *F02D 2041/0092* (2013.01); *F02N 11/0814* (2013.01)

(58) Field of Classification Search

CPC . F02D 41/008; F02D 41/2454; F02D 41/065; F02D 2041/0092; F02N 11/0814

USPC ..... 123/339.1, 339.19, 436, 481, 491, 123/179.3, 179.4, 179.16, 179.17, 672, 679, 123/680, 685; 701/103–105, 110, 112, 113

See application file for complete search history.

(56) References Cited

U.S. PATENT DOCUMENTS

| | | | | |
|---|---|---|---|---|
| 5,241,480 | A | 8/1993 | Takaku et al. | |
| 5,909,724 | A | 6/1999 | Nishimura et al. | |
| 7,599,783 | B2 | 10/2009 | Nakane | |
| 7,606,652 | B2 | 10/2009 | Kaiser et al. | |
| 7,866,303 | B2 | 1/2011 | Storhok et al. | |
| 8,146,557 | B2 | 4/2012 | Storhok et al. | |
| 8,214,129 | B2 | 7/2012 | Pursifull | |
| 8,600,648 | B2 * | 12/2013 | Hashemi | F02D 41/008 123/179.3 |
| 2007/0051342 | A1 | 3/2007 | Kita | |
| 2009/0107441 | A1 | 4/2009 | Husak et al. | |

OTHER PUBLICATIONS

Anonymous, "Real-time Gear Shift Advisory System to Improve Fuel Economy," IPCOM No. 000235514, Published Mar. 5, 2014, 4 pages.

* cited by examiner

*Primary Examiner* — Hai Huynh

(74) *Attorney, Agent, or Firm* — Julia Voutyras; Alleman Hall McCoy Russell & Tuttle LLP

(57) ABSTRACT

Methods and systems are provided for accurately determining cylinder fueling errors during an automatic engine restart. Fueling errors may be learned during a preceding engine restart on a cylinder-specific and combustion event-specific basis. The learned fueling errors may then be applied during a subsequent engine restart on the same cylinder-specific and combustion event-specific basis to better anticipate and compensate for engine cranking air-to-fuel ratio deviations.

21 Claims, 5 Drawing Sheets

500

| | #1 | #2 | #3 | #4 | #5 | #6 | #7 | #8 |
|---|---|---|---|---|---|---|---|---|
| Cyl_1 | Δ1-1 | Δ1-2 | Δ1-3 | Δ1-4 | Δ1-5 | Δ1-6 | Δ1-7 | Δ1-8 |
| Cyl_3 | Δ3-1 | Δ3-2 | Δ3-3 | Δ3-4 | Δ3-5 | Δ3-6 | Δ3-7 | Δ3-8 |
| Cyl_4 | Δ4-1 | Δ4-2 | Δ4-3 | Δ4-4 | Δ4-5 | Δ4-6 | Δ4-7 | Δ4-8 |
| Cyl_2 | Δ2-1 | Δ2-2 | Δ2-3 | Δ2-4 | Δ2-5 | Δ2-6 | Δ2-7 | Δ2-8 |

Set 512 Set 514 Set 512 Set 514

510

| Event # | Cyl. Id. | Fuel. error |
|---|---|---|
| 1 | Cyl_4 | Δ4-1 |
| 2 | Cyl_2 | Δ2-2 |
| 3 | Cyl_1 | Δ1-3 |
| 4 | Cyl_3 | Δ3-4 |
| 5 | Cyl_4 | Δ4-5 |
| 6 | Cyl_2 | Δ2-6 |
| 7 | Cyl_1 | Δ1-7 |
| 8 | Cyl_3 | Δ3-8 |

520

| Event # | Cyl. Id. | Fuel. error |
|---|---|---|
| 1 | Cyl_1 | Δ1-1 |
| 2 | Cyl_3 | Δ3-2 |
| 3 | Cyl_4 | Δ4-3 |
| 4 | Cyl_2 | Δ2-4 |
| 5 | Cyl_1 | Δ1-5 |
| 6 | Cyl_3 | Δ3-6 |
| 7 | Cyl_4 | Δ4-7 |
| 8 | Cyl_2 | Δ2-8 |

FIG. 5

METHOD AND SYSTEM FOR ENGINE SPEED CONTROL

CROSS REFERENCE TO RELATED APPLICATIONS

The present application is a continuation of to U.S. patent application Ser. No. 13/098,683, entitled "METHOD AND SYSTEM FOR ENGINE SPEED CONTROL," filed on May 2, 2011, the entire contents of which are hereby incorporated by reference for all purposes.

FIELD

The present description relates generally to methods and systems for controlling an engine speed, in particular during an engine restart.

BACKGROUND/SUMMARY

Vehicles have been developed to perform an engine stop when idle-stop conditions are met and then to automatically restart the engine when restart conditions are met. Such idle-stop systems enable fuel savings, reduced exhaust emissions, reduced vehicle noise, and the like.

During an engine restart, a target air-to-fuel ratio profile may used to control the generated torque and improve engine startability. Various approaches may be used for air-to-fuel ratio control at the engine start. One example approach is illustrated by Kita in US 2007/0051342 A1. Therein, angular speed information from a crankshaft, during an engine run-up, is used to identify torque deviations from a desired torque profile, as caused by air-to-fuel ratio fluctuations. Fueling adjustments are then used to correct for the air-to-fuel ratio deviations.

However, the inventors herein have identified a potential issue with such an approach. Cylinder-to-cylinder air-to-fuel ratio variations during engine cranking may not be sufficiently addressed with the adjustments of Kita. Specifically, the deviations, and corresponding corrections, are learned in Kita as a function of engine speed-load conditions. However, fueling errors for a particular cylinder may be more tied to the combustion event number from the time the engine is restarted. Since the corrections learned by Kita may not be properly parsed, even when tracked on a per-cylinder basis, the fueling errors may cancel out over time. As a result, cylinder-to-cylinder air-to-fuel ratio deviations may occur during engine cranking, in particular, in vehicles configured to start and stop frequently in response to idle-stop conditions. These deviations may then cause the engine speed to flare or undershoot, leading to NVH issues during engine cranking. As such, this may degrade engine startability and reduce driver feel.

Thus in one example, some of the above issues may be at least partly addressed by a method of controlling an engine. In one embodiment, the method comprises, during an automatic engine restart from an engine stop, correlating fueling errors to engine cylinders based on a number of combustion events from a first combustion event and a cylinder identity. Herein, the fueling errors may be identified based on crankshaft speed fluctuations. In this way, cylinder-specific variations may be better learned and compensated when they are tied to the combustion firing order taking into account the first cylinder to fire during the start. For example, the method may identify the first combustion of the engine restart, before which no cylinders have combusted, and then track air-to-fuel ratio errors according to the order of combustion from that first combustion event. In this way, even when a different cylinder is the first to fire, proper compensation can be provided. Note that air-to-fuel ratio errors may be based on a variety of factors alternatively to crankshaft speed fluctuations. Further, there are various approaches to identify air-to-fuel ratio errors from crankshaft speed fluctuations, and such errors can further be based on exhaust air-to-fuel ratio information.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 5 shows an example of learning fueling errors and adjusting subsequent fueling based on the learned fueling errors.

DETAILED DESCRIPTION

Figure 1:
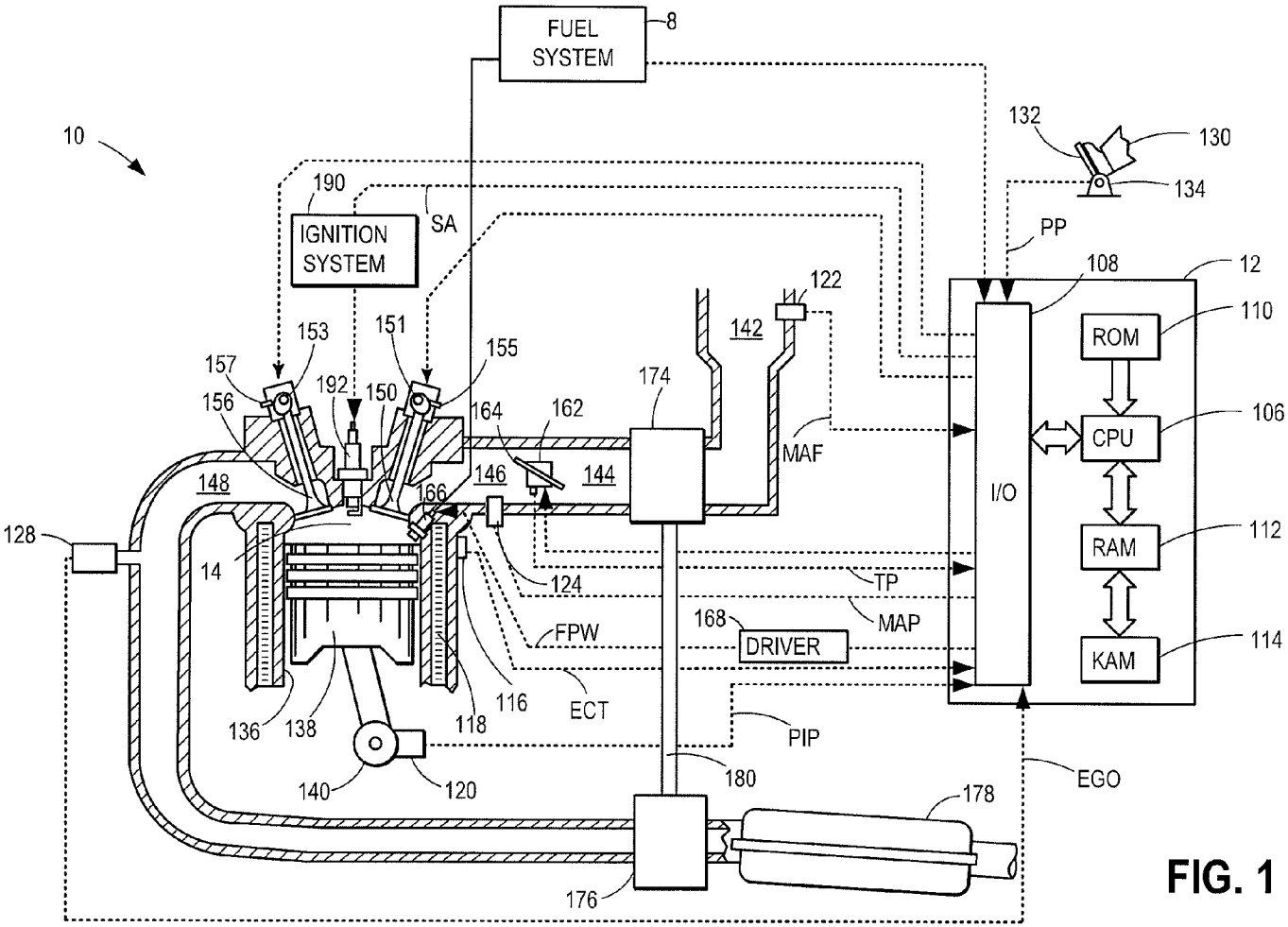
FIG. 1 shows partial engine view.

The following description relates to systems and methods for engine systems, such as the engine system of FIG. 1, configured to be automatically deactivated in response to selected idle-stop conditions, and automatically restarted in response to restart conditions. Specifically, fueling errors may be learned during an engine restart and applied during a subsequent restart to enable a desired engine speed profile to be achieved during engine cranking. An engine controller may be configured to perform control routines, such as those depicted in FIGS. 2-4, to learn fueling errors on a per-cylinder and per-combustion event basis during an automatic restart operation from engine rest, and then apply the learned fueling errors on a per-cylinder per-combustion event basis during a subsequent automatic restart from engine rest. The fueling errors may be learned based on crankshaft speed fluctuations, and stored in a look-up table. An example table of learned fueling errors and their application to subsequent fueling is shown in FIG. 5. By improving the learning of fueling errors, engine speed fluctuations can be reduced, thereby improving the quality of engine restarts.

FIG. 1 depicts an example embodiment of a combustion chamber or cylinder of an internal combustion engine 10. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some embodiments, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be disposed downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Exhaust temperature may be estimated by one or more temperature sensors (not shown) located in exhaust passage 148. Alternatively, exhaust temperature may be inferred based on engine operating conditions such as speed, load, air-fuel ratio (AFR), spark retard, etc.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 150 and exhaust valve 156 may be determined by valve position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. Conventionally, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some embodiments, each cylinder of engine 10 may be configured with one or more fuel injectors for providing fuel thereto. As a non-limiting example, cylinder 14 is shown including one fuel injector 166. Fuel injector 166 is shown coupled directly to cylinder 14 for injecting fuel directly therein in proportion to the pulse width of signal FPW received from controller 12 via electronic driver 168. In this manner, fuel injector 166 provides what is known as direct injection (hereafter also referred to as "DI") of fuel into combustion cylinder 14. While FIG. 1 shows injector 166 as a side injector, it may also be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a high pressure fuel system 8 including fuel tanks, fuel pumps, and a fuel rail. Alternatively, fuel may be delivered by a single stage fuel pump at lower pressure, in which case the timing of the direct fuel injection may be more limited during the compression stroke than if a high pressure fuel system is used. Further, while not shown, the fuel tanks may have a pressure transducer providing a signal to controller 12. It will be appreciated that, in an alternate embodiment, injector 166 may be a port injector providing fuel into the intake port upstream of cylinder 14.

As described above, FIG. 1 shows only one cylinder of a multi-cylinder engine. As such each cylinder may similarly include its own set of intake/exhaust valves, fuel injector(s), spark plug, etc.

Fuel tanks in fuel system 8 may hold fuel with different fuel qualities, such as different fuel compositions. These differences may include different alcohol content, different octane, different heat of vaporizations, different fuel blends, and/or combinations thereof etc.

Controller 12 is shown in FIG. 1 as a microcomputer, including microprocessor unit 106, input/output ports 108, an electronic storage medium for executable programs and calibration values shown as read only memory chip 110 in this particular example, random access memory 112, keep alive memory 114, and a data bus. Storage medium read-only memory 110 can be programmed with computer readable data representing instructions executable by processor 106 for performing the methods and routines described below as well as other variants that are anticipated but not specifically listed. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; absolute manifold pressure signal (MAP) from sensor 124, cylinder AFR from EGO sensor 128, and abnormal combustion from a knock sensor and a crankshaft acceleration sensor. Engine speed signal, RPM, may be generated by controller 12 from signal PIP. Manifold pressure signal MAP from a manifold pressure sensor may be used to provide an indication of vacuum, or pressure, in the intake manifold.

Based on input from one or more of the above-mentioned sensors, controller 12 may adjust one or more actuators, such as fuel injector 166, throttle 162, spark plug 199, intake/exhaust valves and cams, etc. The controller may receive input data from the various sensors, process the input data, and trigger the actuators in response to the processed input data based on instruction or code programmed therein corresponding to one or more routines. Example control routines are described herein with regard to FIGS. 2-4.

Figure 2:
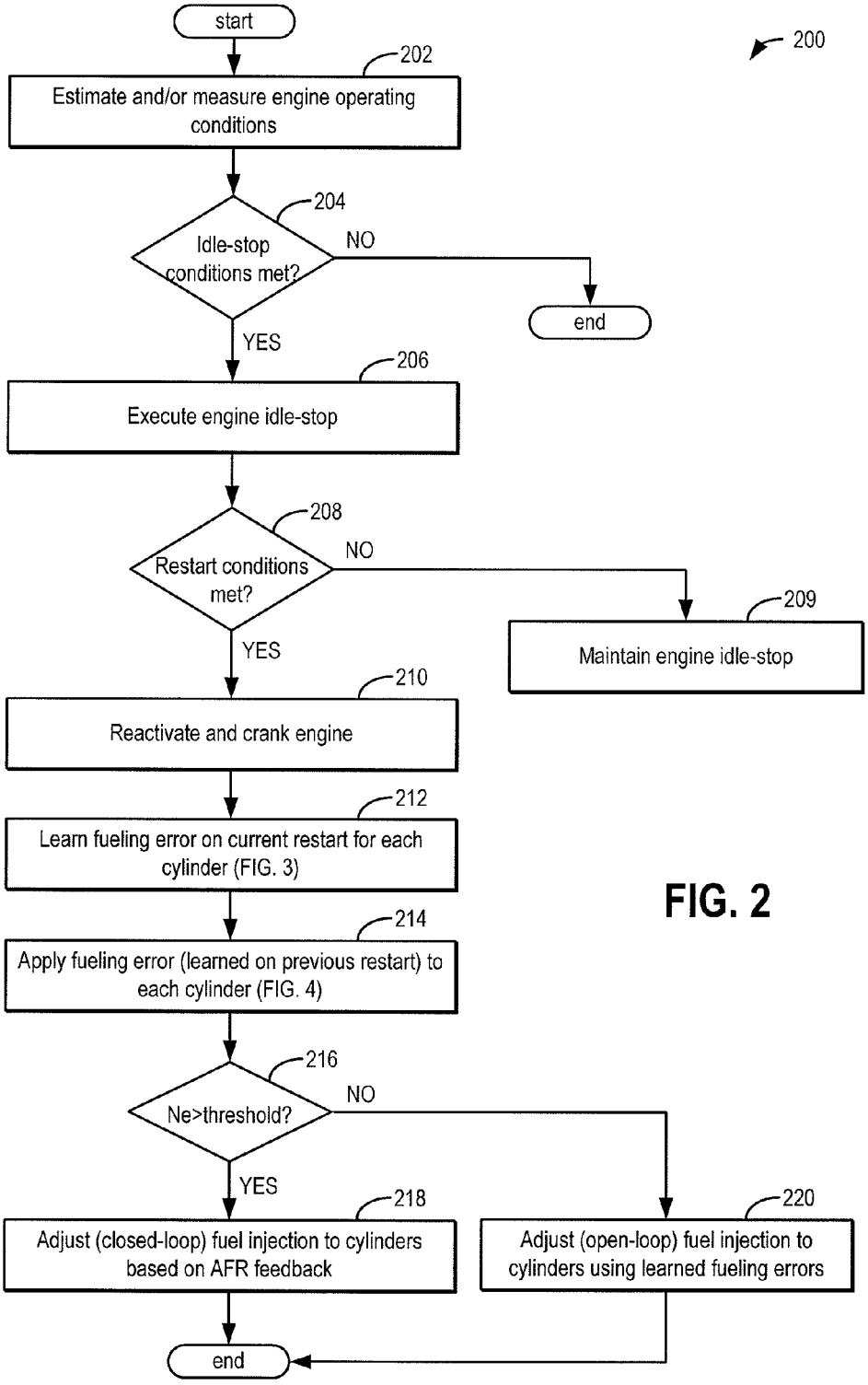
FIG. 2 shows a high level flow chart for automatically restarting an engine from a shut-down condition.

Now turning to FIG. 2, an example routine 200 is described for automatically shutting down an engine in response to idle-stop conditions, and automatically restarting the engine in response to restart conditions. The routine enables the engine to be automatically restarted while applying fueling errors learned on a previous restart operation at the same time as updating the fueling errors based on the current restart operation.

At 202, engine operating conditions may be estimated and/or measured. These may include, for example, ambient temperature and pressure, engine temperature, engine speed, crankshaft speed, transmission speed, battery state of charge, fuels available, fuel alcohol content, etc.

At 204, it may be determined if idle-stop conditions have been met. Idle-stop conditions may include, for example, the engine operating (e.g., carrying out combustion), the battery state of charge being above a threshold (e.g., more than 30%), vehicle speed being below a threshold (e.g., no more than 30 mph), no request for air conditioning being made, engine temperature (for example, as inferred from an engine coolant temperature) being above a threshold, no start being requested by the vehicle driver, driver requested torque being below a threshold, brake pedals being pressed, etc. If idle-stop conditions are not met, the routine may end. However, if any or all of the idle-stop conditions are met, then at 206, the controller may execute an automatic engine idle-stop operation and deactivate the engine. This may include shutting off fuel injection and/or spark ignition to the engine. Upon deactivation, the engine may start spinning down to rest.

While the routine depicts deactivating the engine in response to engine idle-stop conditions, in an alternate embodiment, it may be determined if a shutdown request has been received from the vehicle operator. In one example, a shutdown request from the vehicle operator may be confirmed in response to a vehicle ignition being moved to a key-off position. If an operator requested shutdown is received, the engine may be similarly deactivated by shutting off fuel and/or spark to the engine cylinders, and the engine may slowly spin down to rest.

At 208, it may be determined if automatic engine restart conditions have been met. Restart conditions may include, for example, the engine being in idle-stop (e.g., not carrying out combustion), the battery state of charge being below a threshold (e.g., less than 30%), vehicle speed being above a threshold, a request for air conditioning being made, engine temperature being below a threshold, emission control device temperature being below a threshold (e.g., below a light-off temperature), driver requested torque being above a threshold, vehicle electrical load being above a threshold, brake pedals being released, accelerator pedal being pressed, etc. If restart conditions are not met, at 209, the engine may be maintained in the idle-stop status.

In comparison, if any or all of the restart conditions are met, and no restart request is received from the vehicle operator, at 210, the engine may be automatically restarted. This may include reactivating and cranking the engine. In one example, the engine may be cranked with starter motor assistance. Additionally, fuel injection and spark ignition to the engine cylinders may be resumed. In response to the automatic reactivation, the engine speed may start to gradually increase.

At 212, the routine includes, during the current automatic engine restart from the engine stop, learning and correlating fueling errors to engine cylinders based on a number of combustion events from a first combustion event and a cylinder identity. Herein, the first combustion event is a combustion event before which no combustion event has occurred. In one example, the fueling errors may be identified based on crankshaft speed fluctuations. As elaborated in FIG. 3, the correlating may include differentiating fueling errors for a given cylinder based on a combustion event number, as counted from a first combustion event of the restart. Likewise, the correlating may further include differentiating fueling errors for a given combustion event number (from the first combustion event of the restart) based on a cylinder number. As such, the learning may be carried out on a cylinder-by-cylinder basis for each cylinder of the engine. Subsequent fueling (that is, fueling of cylinders on a subsequent automatic engine restart) may be adjusted based on the correlation learned at 212, as elaborated herein.

At 214, the routine includes adjusting fueling of the engine cylinders based on fueling errors learned on a previous restart. As elaborated in FIG. 4, this includes, for each combustion event during the cranking, determining the combustion event number and the identity of the cylinder firing at that combustion event number, and based on that specific combination, retrieving a fueling error (learned on the previous engine restart) that corresponds to the specific combination, and applying that fueling error. Thus, the fueling errors learned during the current automatic engine restart (at 212) may be applied on a subsequent automatic engine restart, while fueling errors learned during a previous automatic engine restart may be applied on the current automatic engine restart (at 214). In one example, adjusting the fueling may include adjusting the fuel pulse width of a fuel injection to each cylinder based on the learned fueling errors.

It will be appreciated that the correlating and learning (as at 212) may be performed only during an automatic engine restart wherein the engine is restarted in response to restart conditions being met and without receiving a restart request from the operator. In other words, during an operator requested restart from an engine shutdown condition, such as, an engine cold start following an operator-requested shutdown, fueling errors may not be learned on a cylinder-specific and combustion-event specific basis. Likewise, the applying of previously learned fueling errors (as at 214) may also be performed only during an automatic engine restart, and not during an operator requested engine restart (such as, an engine cold start).

In the depicted embodiment, the learning of fueling errors and/or the adjusting of fueling based on the learned correlation may be continued during the engine cranking until the engine speed reaches a threshold speed. Thus, at 216, it may be confirmed whether the engine speed is at or above the threshold speed. In one example, the threshold speed may be an engine idle speed. If the engine idling speed has not been reached, at 220, the routine includes continuing to adjust fuel injection to the engine cylinders in an open-loop fashion based on fueling errors learned on a previous engine restart. Likewise, learning of fueling errors may be continued over the current restart, over a number of engine cycles during the cranking, until the engine speed reaches the threshold speed. As such, before the engine reaches the idling speed, a temperature at one or more exhaust gas sensors may be below an operating temperature, and air-to-fuel ratio feedback received from them may not be reliable. In comparison, at the lower engine speeds, the crankshaft speed sensor may have higher resolution, and may correlate with engine speeds more accurately. Thus, by feed-forward compensating for air-to-fuel ratio disturbances using more reliable learned fueling errors when air-to-fuel ratio feedback is less reliable, engine cranking torque disturbances may be reduced.

After the engine reaches the threshold speed, at 218, the routine includes, adjusting subsequent fueling of the engine cylinders in a closed-loop fashion based on air-to-fuel ratio feedback. The air-to-fuel ratio feedback may be received from an exhaust gas sensor, such as an exhaust gas oxygen sensor. As such, by the time the engine has reached an idling speed, the exhaust gas sensor may have reached an operating temperature and may provide accurate air-to-fuel ratio feedback. Thus, by feed-back compensating for air-to-fuel ratio disturbances using air-to-fuel ratio feedback only when the feedback is reliable, engine cranking torque disturbances may be reduced.

In this way, fueling errors may be learned and compiled over a number of engine cycles during an engine run-up. By tying fueling errors not only to a particular cylinder but also to a particular combustion event, cylinder-to-cylinder air-to-fuel ratio variations, as well as combustion event-to-event variations may be better parsed. By better estimating air-to-fuel ratio disturbances, torque and engine speed fluctuations during a subsequent engine run-up may be better anticipated and compensated for. By reducing engine speed and torque fluctuations, NVH issues may be reduced. In this way, engine startability may be improved.

Figure 3:
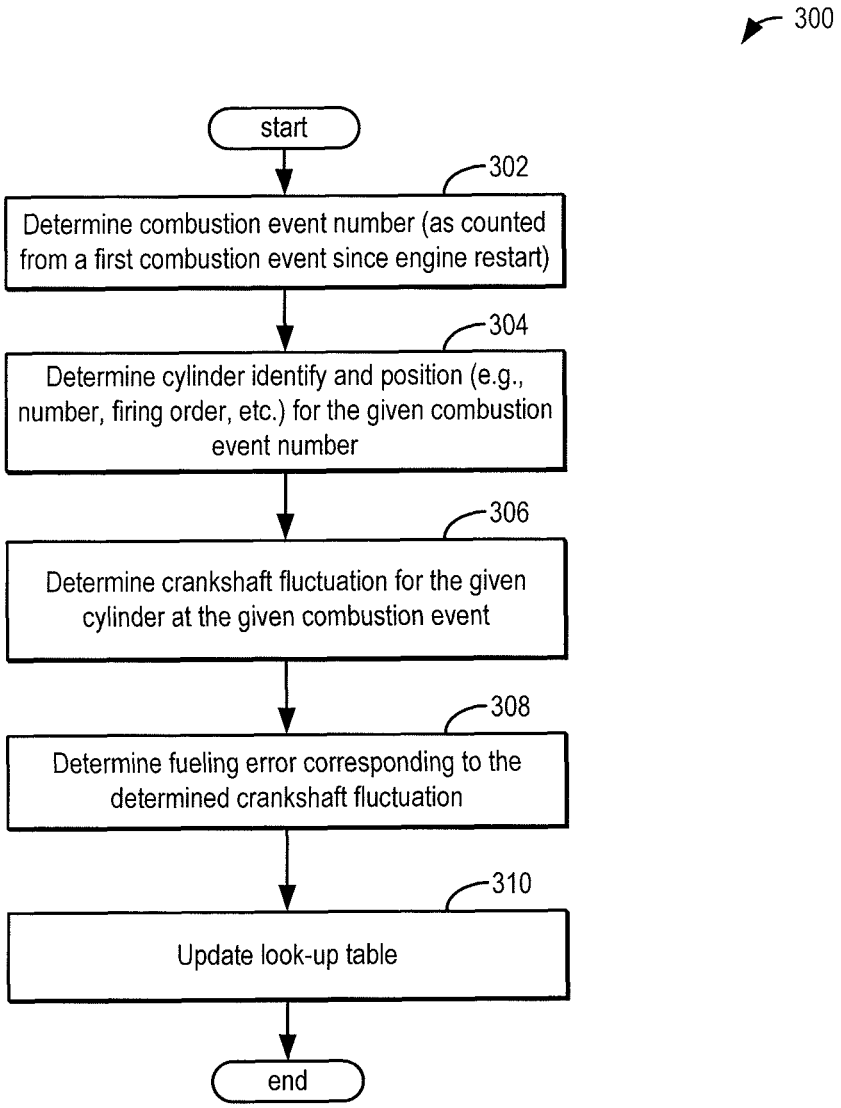
FIG. 3 shows a high level flow chart for learning fueling errors, accordingly to the present disclosure.

Now turning to FIG. 3, an example routine 300 is described for learning fueling errors during an automatic engine restart. The routine of FIG. 3 may be performed as part of the routine of FIG. 2, such as at 212. It will be appreciated that the routine of FIG. 3 may be performed for each combustion event of the automatic engine restart, over a number of engine cycles, while the engine is cranking.

At 302, a combustion event number may be determined, as counted from a first combustion event from the engine restart, before which event no combustion may have occurred in the cylinder. For example, it may be determined whether a given combustion event is a first, second, third, fourth, etc., combustion event. At 304, the identity of the cylinder firing at the given combustion event may be determined. The identity may include a cylinder number, cylinder position, and/or cylinder firing order position. As such, the cylinder identity may reflect the cylinder's physical position in the engine block and may or may not coincide with its firing order. In one example, the engine may be a four cylinder in-line engine with cylinders numbered successively (1-2-3-4) in series starting from an outer cylinder of the row, but where the cylinders fire in the sequence 1-3-4-2. Herein, it may be determined whether the cylinder firing at the given combustion event is cylinder 1, 2, 3 or 4.

At 306, a crankshaft fluctuation may be determined for the given cylinder at the given combustion event. The crankshaft fluctuation may be estimated by a crankshaft speed sensor configured to estimate a crankshaft speed. Based on the crankshaft fluctuations, at 308, a fueling error may be learned for the specific combination of the determined combustion event number and the corresponding cylinder number. The learned fueling error may be used to update a look-up table. For example, the controller may include a memory, and the controller may store the fueling error for each cylinder in a look-up table in the controller's memory (e.g., in the KAM), the table referenced by cylinder identity and combustion event number from engine rest. An example look-up table storing learned fueling errors is shown with reference to FIG. 5.

Learning fueling errors based on crankshaft fluctuations may include, for example, estimating a torque generated by each individual cylinder from the engine speed profile or the observed crankshaft speed after each crank event. Since torque is a function of air-to-fuel ratio, an air-to-fuel ratio is also estimated for each individual cylinder based on the crankshaft speed or engine speed profiles. After a number of crank events (e.g., one or multiple), a difference between the estimated air-to-fuel ratio and the desired air-to-fuel ratio is determined. A correction based on the difference is learned and saved in the controller's memory (e.g., in the KAM) for use in adapting a future air-to-fuel ratio. For example, based on the correction, a fuel pulse width of a cylinder fuel injection may be varied.

As such, the engine dynamics are governed by an ordinary differential equation of the form:

$$J\frac{d\omega}{dt} + B\omega(t) = \tau(t), \tag{1}$$

where J, B, and $\omega(t)$, are the engine inertia, damping, and speed respectively. The torque produced by combustion is shown by $\tau(t)$. Assuming the engine speed before a combustion related to a cylinder is $\omega(t_k)$, and after the combustion of the same cylinder is $\omega(t_{k+1})$, then, $$\omega(t_{k+1}) = \frac{\tau_k + J\omega(t_k))}{J}e^{-\frac{B}{J}(t_{k+1}-t_k)}, \tag{2}$$

where $\tau(k)$ is the torque produced by the k-th combustion. Herein, it is assumed that $\tau(k)=\tau^j$ if the k-th torque is produced by the j-th cylinder. This means that we assume all the torques produced by the cylinders during the crank are almost equal. However, cylinder-to-cylinder produced torques can be different due to cylinder-to-cylinder air-to-fuel ratio distribution errors related to variability in injectors or cylinders.

Without loss of generality, the following equations may be focused on cylinder 1 and the results may be used to estimate the torque generated by other cylinders. Thus equation (2) may be re-ordered to obtain:

$$\omega(t_{k+1}) - \omega(tk)e^{-\frac{B}{J}(t_{k+1}-t_k)} = \tau^1\frac{1}{J}e^{-\frac{B}{J}(t_{k+1}-t_k)}, \tag{3}$$

The following factors are then introduced, $$y_k = \omega(t_{k+1}) - \omega(tk)e^{-\frac{B}{J}(t_{k+1}-t_k)} \tag{4}$$

and $$x_k = \frac{1}{J}e^{-\frac{B}{J}(t_{k+1}-t_k)},$$

and the equation now estimates $\tau^1$ (torque in cylinder 1) from the observations $y_k$ and $x_k$ where k=0, 1, 2, . . . , n. The least square method may be used to estimate the torque produced in cylinder 1, and consequently the air-to-fuel ratio in cylinder 1. The solution is calculated as follows:

$$\tau^1 = \left(\sum_{k=0}^{n} x_k y_k\right)\left(\sum_{k=0}^{n} x_k^2\right)^{-1}. \tag{5}$$

Since the estimated torque is a known function of the air-to-fuel ratio, it can be found according to:

$$A/F^1 = \frac{\eta_f Q_{HV} m_{cyl}}{4\pi\tau^1}, \tag{6}$$

where $\eta_f$ is the fuel conversion efficiency, $Q_{HV}$ is the fuel heating value, $A/F^1$ is the estimated air-to-fuel ratio of cylinder 1, and $m_{cyl}$ is the mass of air introduced to the cylinders per 720 crank angle degree cylinder.

The air-to-fuel ratio of the other cylinders may be similarly estimated following the same steps. If the estimated air-to-fuel ratio of a cylinder deviates from the desired air-to-fuel ratio, after one or multiple crank events, the desired correction (or fueling error) may be saved in the memory (e.g., in KAM) for future crank events.

Figure 4:
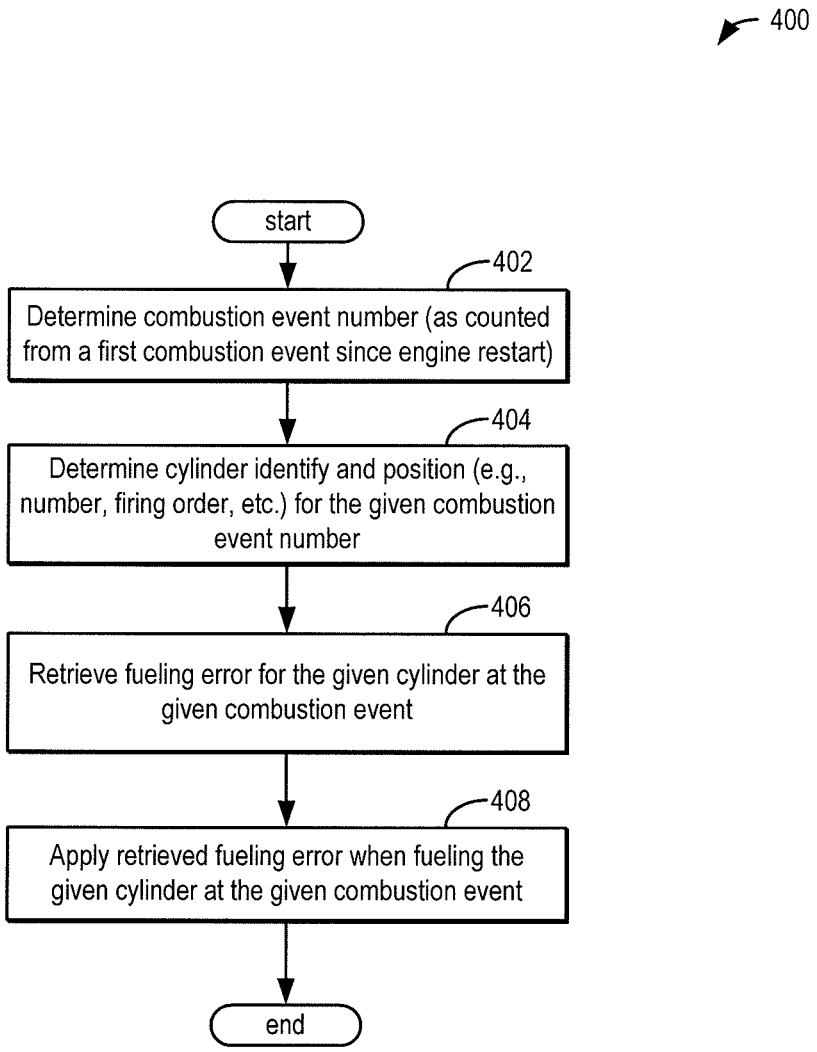
FIG. 4 shows a high level flow chart for applying the learned fueling errors, according to the present disclosure.

Now turning to FIG. 4, an example routine 400 is described for applying the fueling errors learned during a first automatic engine restart on a second, subsequent automatic engine restart. The routine of FIG. 4 may be performed as part of the routine of FIG. 2, such as at 214. It will be appreciated that the routine of FIG. 4 may be performed during each combustion event of the subsequent automatic engine restart, over a number of engine cycles, while the engine is cranking.

At 402, the combustion event number may be determined, as counted from a first combustion event of the engine restart. For example, it may be determined whether the given combustion event is a first, second, third, fourth, etc., combustion event. At 404, the identity of the cylinder firing at the given combustion event may be determined. As such, the engine may include a plurality of cylinders position along the engine block. Herein, it may be determined as to which specific cylinder fired on that combustion event. With reference to the previous example of a four cylinder in-line engine, it may be determined whether the cylinder firing at the given combustion event is cylinder 1, 2, 3 or 4. As such, based on the position of the piston at the time of a previous engine shutdown, the cylinder selected for a first combustion event during the automatic engine restart may vary. The engine controller may select a cylinder for the first combustion based on fueling and air-charge considerations. For example, a cylinder may be selected based on the position of the piston (e.g., a cylinder that had stopped in an intake stroke), the crankshaft angle of the cylinder, etc.

At 406, a fueling error corresponding to the specific combination of the combustion event number and the cylinder number may be retrieved from the look-up table. That is, the fueling error selected corresponds to the particular combustion event number (identified at 402) in a particular cylinder (identified at 404), but not any other cylinder of the engine. Likewise, the fueling error applied corresponds to the particular cylinder when firing at the given combustion event number, but not any other combustion event number during the restart. At 408, the retrieved fueling error may be applied to adjust fueling of the particular cylinder at the particular combustion event.

As an example, the controller may learn a first fueling error for a first cylinder when the first cylinder is at a first number of combustion events from the first combustion event, and learn a second fueling error for the first cylinder when the first cylinder is at a second number of combustion events form the first combustion event. Then, during a second, subsequent, automatic engine restart, the controller may apply the first fueling error only when the first cylinder is at the first number of combustion events from a first combustion event of the second restart, and apply the second fueling error only when the first cylinder is at the second number of combustion events from the first combustion event of the second restart. That is, the first fueling error may not be applied if the first cylinder is at a second combustion event number. Likewise, the second fueling error may not be applied if the second cylinder is at the first combustion event number.

As another example, the controller may learn a first fueling error for a first cylinder firing at a first combustion event number, and learn a second fueling error for a second cylinder firing at the first combustion event number. Herein, the first combustion event number is counted from the first combustion event of a first automatic engine restart. Then, during a second, subsequent, automatic engine restart, the controller may apply the first fueling error when the first cylinder is firing at the first combustion event number (as counted from a first combustion event of the second restart), and apply the second fueling error when the first cylinder is firing at the second combustion event number (as counted from the first combustion event of the second restart). Herein, the first fueling error may not be applied if a second cylinder is firing at the first combustion event number. Likewise, the second fueling error may not be applied if a second cylinder is firing at the second combustion event number.

The fueling errors may be learned and compiled during engine cranking of the first, preceding engine restart, before the engine speed reaches an idling speed. Then, the fueling errors may be applied during engine cranking of the second, subsequent engine restart, also before the engine speed reaches the idling speed. Once the engine reaches the idling speed, and after the exhaust gas sensors have sufficiently warmed up, fueling to the cylinders may be adjusted based on air-to-fuel ratio feedback from the exhaust gas sensors.

An example of selectively applying learned fueling errors, as per the routines of FIGS. 2-4, is now shown with reference to FIG. 5. Specifically, FIG. 5 shows a table 500 of fueling errors learned during a first automatic engine restart. Table 500 is depicted as a look-up table, referenced by cylinder identity and combustion event number from engine rest. The table may be stored in the controller's memory and updated during each engine restart. FIG. 5 further shows a first example 510, and a second example 520, of applying the learned fueling errors during a subsequent engine restart.

During a first automatic engine restart from engine stop, an engine controller may learn a fueling error on a per-cylinder position basis and on a per-combustion event number basis. Herein, the automatic engine restart from engine stop includes restarting the engine without receiving a restart request from a vehicle operator. The learned fueling errors may then be stored in look-up table 500. As used herein, the cylinder position refers to the position of the cylinder in the engine block, and correlates with its number. In the depicted example, the engine may be a four cylinder in-line engine having cylinders numbered Cyl_1 through Cyl_4, in series, starting from an outer cylinder of the row. It will be appreciated that in the depicted example, the cylinder numbers do not correspond with the firing order of the cylinders, the firing order being Cyl_1, followed by Cyl_3, followed by Cyl_4, followed by Cyl_2, and then returning back to Cyl_1. However in alternate engine configurations, such as in an in-line three cylinder engine, the cylinder position may correlate with the firing order position.

Fueling errors may be learned for a number of engine cycles before an engine speed reaches a threshold speed (e.g., an engine idling speed). In the depicted example, table 500 shows fueling errors collected over two engine cycles (that is, eight combustion events of the four cylinder engine). Herein, the two engine cycles are the first two engine cycles from the engine rest. The eight combustion events are, accordingly, numbered event #1-8, with event #1 indicating a first combustion event since the engine rest, event #2 indicating a second combustion event since the engine rest, and so on. The fueling errors are tabulated and referenced according to cylinder position (Cyl_1 through Cyl_4) and combustion event number (event #1 through event #8). Thus, fueling error Δ1-1 may be learned when Cyl_1 is the cylinder firing at the first combustion event, fueling error Δ1-2 may be learned when Cyl_1 is the cylinder firing at the second combustion event, and so on. Similarly, fueling error Δ2-1 may be learned when Cyl_2 is the cylinder firing at the first combustion event, fueling error Δ3-1 may be learned when Cyl_3 is the cylinder firing at the first combustion event, and so on.

During a second automatic engine restart from engine stop, the controller may adjust cylinder fueling based on a cylinder position and a current combustion event number. In this case, the combustion event number is counted from a first combustion event of the second engine restart. Specifically, the controller may apply a fueling error, from the fueling error table 500, as learned on the first automatic engine restart based on the cylinder position and current combustion event number. That is, a fueling error corresponding to the specific combination of cylinder position and combustion event number may be applied.

In a first example 510, the second automatic engine restart may be initiated with cylinder 4 firing at the first combustion event. Thus, on the first combustion event, fueling error Δ4-1 may be applied. On the second combustion event, when cylinder 2 fires, fueling error Δ2-2 may be applied, and so on. Since the firing order of the cylinders is known, once the first firing cylinder is identified, herein Cyl_4, the controller may follow set 512 for adjusting fueling errors.

In a second example 520, the second automatic engine restart may be initiated with cylinder 1 firing at the first combustion event. Thus, on the first combustion event, fueling error Δ1-1 may be applied. On the second combustion event, when cylinder 3 fires, fueling error Δ3-2 may be applied. Since the firing order of the cylinders is known, once the first firing cylinder is identified, herein Cyl_1, the controller may follow set 514 for adjusting fueling errors.

In this way, fueling errors for specific cylinders firing at specific combustion events, as learned over a preceding automatic engine restart from engine rest, may be applied to better anticipate and correct for air-to-fuel ratio deviations when the specified cylinders firing at the specified combustion events, over a subsequent automatic engine restart from engine rest. As such, this enables cylinder-to-cylinder variations and combustion event-to-event variations to be better compensated for. By learning and feed-forward applying fueling errors during a selected period of engine cranking, crankshaft fluctuations may be advantageously used to correct for torque disturbances when exhaust gas sensors are less sensitive, but crankshaft speed sensors are more sensitive. By feedback adjusting cylinder fueling based on an exhaust gas sensor output after the selected period of engine cranking, the feedback may be advantageously used to correct for torque disturbances when exhaust gas sensors are more sensitive. By improving correction of fueling anomalies during engine crank, a desired engine speed profile may be achieved, NVH issues may be reduced, and engine startability may be improved.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine system, comprising:

a turbocharged engine that is selectively deactivated during idle-stop conditions, the engine including a variable cylinder valve timing actuation system;

a plurality of engine cylinders, each cylinder including a direct fuel injector for receiving an amount of fuel;

a crankshaft speed sensor coupled to a crankshaft of the turbocharged engine;

an exhaust gas air-to-fuel ratio sensor coupled in an exhaust of the turbocharged engine; and a controller with non-transitory computer readable instructions for, during a first engine restart, learning a fueling error for each of the plurality of cylinders, the fueling error for each of the plurality of cylinders based on crankshaft speed fluctuations of a given cylinder firing at a given combustion event number from an engine rest; and during a second, subsequent engine restart, applying the learned fueling error when the given cylinder is firing at the given combustion event number from engine rest.

2. The system of claim 1 further comprising an ignition system including a spark plug coupled in the engine cylinder.

3. The system of claim 2 further comprising a three-way catalyst coupled in the engine exhaust.

4. The system of claim 3 wherein the engine is a four cylinder engine.

5. A method of operating a turbocharged engine, comprising:

during a first automatic engine restart from engine idle-stop, learning fueling errors on a per-cylinder position basis and on a per-combustion event number basis, the combustion event number counted from a first combustion event of the first engine restart; and during a second automatic engine restart from engine idle-stop, adjusting cylinder fueling based on a cylinder position and a current combustion event number, the combustion event number counted from a first combustion event of the second engine restart.

6. The method of claim 5, wherein the fueling errors are based on crankshaft speed fluctuations.

7. The method of claim 5, wherein adjusting cylinder fueling includes, applying the fueling errors learned on the first automatic engine restart based on the cylinder position and the current combustion event number from rest.

8. The method of claim 7 wherein the learning includes learning fueling errors for a number of engine cycles before an engine speed reaches a threshold speed, and wherein the adjusting includes applying the learned fueling errors until the engine speed reaches the threshold speed.

9. The method of claim 8, wherein the applying further includes, after the engine speed reaches the threshold speed, adjusting cylinder fueling based on air-to-fuel ratio feedback from an exhaust gas sensor.

10. A method of controlling an engine, comprising, during an automatic engine restart from an engine idle-stop with engine temperature greater than a threshold and the engine spun down to rest, correlating fueling errors to engine cylinders based on a number of combustion events from a first combustion event and a cylinder identity, including which cylinder was the first combustion event, the fueling errors identified based on crankshaft speed fluctuations.

11. The method of claim 10, wherein the correlating is carried out for each cylinder of the engine on a cylinder-by-cylinder basis, the engine being a four cylinder turbocharged engine, the fuel injected by direct fuel injectors.

12. The method of claim 11, wherein the correlating includes differentiating fueling errors for a given cylinder based on a combustion event number from the first combustion event of the engine restart.

13. The method of claim 12, wherein the correlating further includes differentiating fueling errors for a given combustion event number from the first combustion event of the engine restart based on a cylinder number.

14. The method of claim 13, further comprising, adjusting subsequent fueling based on the correlation.

15. The method of claim 14, wherein differentiating fueling errors for a given cylinder includes, learning a first fueling error for a first cylinder when the first cylinder is at a first number of combustion events from the first combustion event, and learning a second fueling error for the first cylinder when the first cylinder is at a second number of combustion events from the first combustion event.

16. The method of claim 15, wherein the correlating is during a first automatic engine restart, and wherein the adjusting includes, during a second, subsequent, automatic engine restart, applying the first fueling error when the first cylinder is at the first number of combustion events from a first combustion event of the second engine restart, and applying the second fueling error when the first cylinder is at the second number of combustion events from the first combustion event of the second engine restart.

17. The method of claim 14, wherein differentiating fueling errors for a given combustion event number includes, learning a first fueling error for a first cylinder firing at a first combustion event number, and learning a second fueling error for a second cylinder firing at the first combustion event number, the first combustion event number counted from the first combustion event.

18. The method of claim 17, wherein the correlating is during a first automatic engine restart, and wherein the adjusting includes, during a second, subsequent, automatic engine restart, applying the first fueling error when the first cylinder is firing at the first combustion event number from a first combustion event of the second restart, and applying the second fueling error when the second cylinder is firing at the first combustion event number.

19. The method of claim 14, wherein the correlating includes learning fueling errors until an engine speed reaches a threshold speed.

20. The method of claim 19, wherein the adjusting includes adjusting subsequent fueling based on the correlation until the engine speed reaches the threshold speed, and after the engine speed reaches the threshold speed, adjusting subsequent fueling based on air-to-fuel ratio feedback.

21. The method of claim 10, wherein the automatic engine restart from engine stop includes restarting the engine without receiving a restart request from a vehicle operator.

* * * * *